United States Patent [19]

Heitzenröder et al.

[11] Patent Number: 4,715,494

[45] Date of Patent: Dec. 29, 1987

[54] INTERNALLY PRESSURIZED PACKAGE WITH HEAT-SEALABLE CLOSURE MEMBER

[75] Inventors: Hans Heitzenröder, Langenselbold; Eckhard Merz, Lich, both of Fed. Rep. of Germany

[73] Assignee: Dunlop Limited a British Company, United Kingdom

[21] Appl. No.: 836,124

[22] Filed: Mar. 4, 1986

[30] Foreign Application Priority Data

Mar. 13, 1985 [DE] Fed. Rep. of Germany ..... 3509027

[51] Int. Cl.[4] ..... B65D 81/20

[52] U.S. Cl. ..... 206/213.1; 53/479; 206/315.9; 220/209; 383/103

[58] Field of Search ..... 206/315.9, 205, 524.8, 206/213.1; 383/58, 44, 45, 100, 103, 48, 49, 51, 59; 220/202, 203, 209; 53/403, 407, 434, 479

[56] References Cited

U.S. PATENT DOCUMENTS

| | | | |
|---|---|---|---|
| 2,835,596 | 5/1958 | Kaufman | 53/403 |
| 2,870,954 | 1/1959 | Kulesza | 206/524.8 |
| 3,026,656 | 3/1962 | Rumsey, Jr. | 383/103 X |
| 3,268,152 | 8/1966 | Swartz | 383/58 X |
| 3,584,671 | 6/1971 | Kampa . | |
| 3,952,869 | 4/1976 | Sanson | 206/363 |
| 4,134,535 | 1/1979 | Barthels et al. | 383/103 X |
| 4,310,118 | 1/1982 | Kisida et al. | 383/103 X |
| 4,384,646 | 5/1983 | Sakamoto et al. | 206/315.9 |
| 4,420,015 | 12/1983 | Blaser | 220/209 X |

FOREIGN PATENT DOCUMENTS

| | | |
|---|---|---|
| 370535 | 4/1932 | United Kingdom . |
| 1370417 | 10/1974 | United Kingdom . |

*Primary Examiner*—George E. Lowrance
*Assistant Examiner*—Bryon Gehman
*Attorney, Agent, or Firm*—Stevens, Davis, Miller & Mosher

[57] ABSTRACT

A pressure-tight packaging, intended particularly for tennis balls, has an opening (3) which is adapted to be sealed by a closure member (4) upon pressurizing the container. Closure member (4) is of substantially planar configuration and is made of a plastics material, which is first warmed by the pressurizing gas on filling the container and is then forced into abutment with the container wall by the gas pressure so as to become welded or glued to the container wall and thus to seal the opening (3).

7 Claims, 2 Drawing Figures

INTERNALLY PRESSURIZED PACKAGE WITH HEAT-SEALABLE CLOSURE MEMBER

Figure 1:
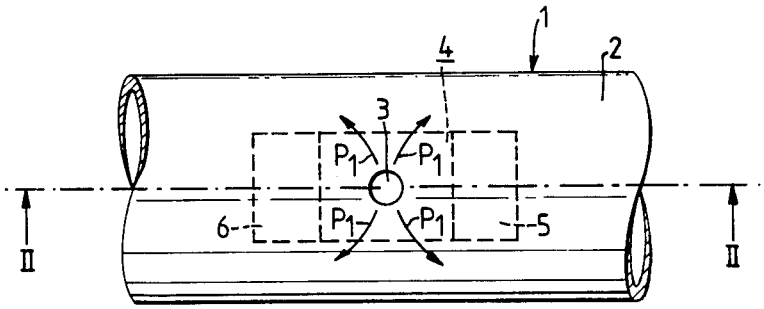

This invention relates to a pressure-tight packaging, particularly for tennis balls and the like, consisting of a container which is closed on all sides except for an opening provided in one wall which can be sealed by building up pressure within the container.

Various kinds of containers which are used for packaging of objects under increased pressure are known. In addition to flexible containers which are provided with valves, packaging containers are also known in which the pressure build-up in the closed container is achieved by introducing solidified or liquefied gases into the container prior to final closure. This latter method does indeed make it possible to dispense with comparatively expensive valve arrangements, but is also necessitates rapid closure of the container after the introduction of the solid or liquid gas in order to prevent premature formation and/or escape of gas. Furthermore, in the event of a too rapid pressure build-up in containers of this type, the welding seams can be forced open. Thus, with known containers, it is difficult to ensure reliable automatic packaging and accurately to maintain in the packaging the desired internal pressure.

The present invention, therefore, aims to provide a pressure-tight packaging which is particularly simple and economical to make, which makes possible a fully accurate and reproducible setting and maintenance of the internal pressure and which, without the risk of loosening the welding seams, permits automated filling.

Thus, the present invention provides a pressure-tight packaging consisting of a container which is closed on all sides except for an opening provided in one wall and a closure member adjacent said opening on the inside of said container, said closure member being of planar configuration, being first attached in a punctiform manner to the wall, and being adapted to be tightly attached to the wall by the action of heat and/or pressure so as to seal said opening.

The planar closure member, which is installed in the course of production of the container, allows the container to be brought, at the instant at which there is no longer any risk of the welding seams being forced open, to the required internal pressure by the injection of chemically-inert gas, e.g. air. When the required internal pressure is reached, the external pressure is removed and the internal pressure forces the planar closure member against the inside of the container to seal the opening. The gas used to pressurise the container is preferably injected at elevated temperature, whereby a welding capability between closure component and wall is produced. Thus, when the external pressure is removed, the closure member is forced against the wall of the container to form a permanent seal.

Preferably, the container includes, at least on the inside, a plastics layer, and a plastics strip is used as the closure member. In the case of the packaging of tennis balls, it is advantageous to use a container made of a single- or multi-layer flexible plastics material and to make this container tubular in configuration. Packaging of this type is particularly economical to produce, ensures that there is no risk of the welding seams being forced open and that an accurately predetermined internal pressure can be maintained.

In a preferred embodiment, the plastics strip which forms the closure member is attached at its two end regions to the wall of the container and the region of the closure member situated between the points of attachment is adapted to be welded or glued to the container wall at elevated temperature and/or pressure.

The temperature increase necessary for the purpose of this attachment can be quite simply achieved by injecting the pressurising gas in a warmed or heated state. Effectively, the gas "sweeps" over the surface of the plastics strip and the inner wall which will be forced into abutment after removal of the external pressure and thereby heats the abutting surfaces so that they become welded together to seal the container.

Preferably, the surfaces of the wall and/or the strip which are to be forced into abutment are provided with a layer of a heat-activatable adhesive or with fusion adhesive foils. In this way it is possible to work at comparatively low activation temperatures and nevertheless ensure a satisfactory seal.

Preferably, the closure member and the portion of the container wall opposite thereto are made of the same plastics material, e.g. a polyester-based material.

Figure 2:
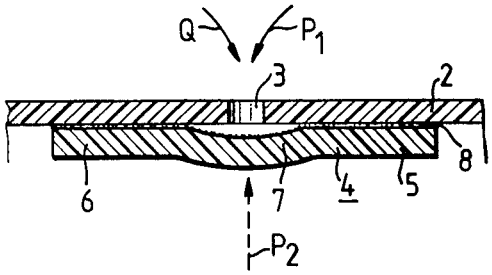

A particularly preferred embodiment of the present invention will be illustrated, merely by way of example, in the following description and with reference to the accompanying drawings. In the drawings:

FIG. 1 is a schematic perspective view of part of a packaging container according to the present invention; and FIG. 2 is a section on line II—II of FIG. 1.

In FIG. 1, a tubular container 1, intended particularly for the packaging of tennis balls, has a longitudinal welding seam as well as two end welding seams (seams not shown). All the welding seams are pressure-tight.

The pressurising gas is introduced by way of a hole 3 in the container wall, the hole being adapted to be closed in a pressure-tight manner when the required internal pressure is reached in the container.

The pressure-tight closing of the hole 3 is achieved by means of a strip-like closure member 4, which is fitted so as to mask the hole 3 from the inside of the container wall.

The closure member 4 consists of a rectangular strip, the two end regions 5 and 6 of which are welded or glued to the container wall.

By the application of external pressure at the desired instant, the pressurising gas can be introduced through the hole 3. The gas "sweeps", in the direction of the arrow $P_1$, over that region of the closure member 4 which is not yet attached to the container wall. Consequently, the gas also "sweeps" over the container wall lying adjacent the closure member 4. Preferably, warmed or heated gas (e.g. air in the case of the packaging of tennis balls), is used as the pressurising gas, and the result of this is that the central region of the closure member 4 as well as that wall region of the container 1 which is associated therewith, are warmed or heated to the extent that the closure member can become welded or glued in a pressure-tight manner to the wall at the instant when the external pressure $P_1$ is removed and the built-up internal pressure in the container presses the closure member 4 against the inner wall of the container to seal the hole 3.

FIG. 2 shows the hole 3 which is provided in the container wall 2, as well as the closure member 4 which is attached at its two end regions 5 and 6 to the wall 2 and is still free opposite the hole 3, to permit entry of the pressurising gas. Arrow $P_1$ represents the application of pressurising gas at a specific pressure and arrow Q represents that this pressurising gas at the same time serves for the introduction of heat energy, i.e. the gas is warmed or heated. The resulting pressure in the interior of the container is represented by arrow $P_2$.

The central region 7 of the plastics closure member 4 is, upon application of the external pressure $P_1$, pushed away from the inside of the wall 2, so that the pressurising gas can flow into the container and at the same time heat the said central region 7 as well as the corresponding wall region. It is possible to either weld the closure member and the container wall directly to each other or to provide therebetween a layer 8 of a fusion adhesive or a fusion adhesive foil. Alternatively, a layer of a heat-activatable adhesive may be used, whereby it becomes possible to work at a comparatively low temperature of the pressurising gas, in order, after removal of the external pressure $P_1$, to obtain a satisfactory seal.

The introduction of the pressurising gas can be effected in accordance with known methods, for example by pumping or the like. The temperature of the pressurising gas is determined by the materials that are to be welded or by the adhesives to be used. The choice of adhesive or of the materials to be welded is also dependent upon the goods to be packaged.

The packaging in accordance with the present invention is thus distinguished by particular economy, by substantial advantages in production (since it facilitates automation and allows a free choice of the instant of the pressure application) as well as by long-term stability, since the risk of the welding seams being forced open before packaging is complete is minimised.

We claim:

1. A pressure-tight packaging made of tubular flexible plastic material having sealed ends, with an initially heated gas contained therein and means to enable pressurizing and maintaining a gas pressure in said pressure-tight packaging without disturbing said sealed ends, said means comprising an opening in one packaging wall remote from the sealed ends of said pressure-tight packaging and a means for sealing said opening, said means comprising an elongated closure member for said opening said closure member comprising an imperforate material which is heat sealable at the temperature of the initially heated gas used to pressurize said container, said closure member being of planar configuration and being first attached by its opposed ends to the inner surface of said wall adjacent said opening to overlie said opening but defining a passage between said closure member and the wall immediately adjacent to the opening so as to permit gas entering said opening to enter said closed container, the positioning of the closure member in relation to the inner surface of the wall being such that when said container is internally pressurized with the gas at a temperature sufficient to activate said heat-sealable material and a pressure sufficient to urge said closure member against said opening, a permanent seal is formed.

2. The packaging of claim 1, wherein the inner surface of said packaging includes a plastics layer and said closure member comprises a plastics strip.

3. The packaging of claim 1, wherein said packaging is made of a single- or multi-layer flexible plastics material.

4. The packaging of claim 1, wherein the surfaces of said packaging wall or said closure member which are to be attached to each other are provided with a layer of an adhesive material.

5. The packaging of claim 1, wherein said closure member and said packaging wall opposite thereto are made of the same plastics material.

6. The packaging of claim 1, wherein said pressurising gas is a chemically-inert gas.

7. The packaging of claim 6, wherein said pressurising gas is air.

* * * * *